US011536166B2

(12) United States Patent
Bayrakdar

(10) Patent No.: US 11,536,166 B2
(45) Date of Patent: Dec. 27, 2022

(54) HYDRAULIC CAMSHAFT ADJUSTER

(71) Applicant: Schaeffler Technologies AG & Co. KG, Herzogenaurach (DE)

(72) Inventor: Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 311 days.

(21) Appl. No.: 16/651,048

(22) PCT Filed: Sep. 19, 2018

(86) PCT No.: PCT/DE2018/100794
§ 371 (c)(1),
(2) Date: Mar. 26, 2020

(87) PCT Pub. No.: WO2019/091511
PCT Pub. Date: May 16, 2019

(65) Prior Publication Data

US 2021/0388743 A1 Dec. 16, 2021

(30) Foreign Application Priority Data

Nov. 9, 2017 (DE) ..... 102017126171.0

(51) Int. Cl.
*F01L 1/344* (2006.01)

(52) U.S. Cl.
CPC ... *F01L 1/3442* (2013.01); *F01L 2001/34426* (2013.01); *F01L 2001/34459* (2013.01)

(58) Field of Classification Search
CPC ..... F01L 1/344; F01L 1/3442; F01L 1/34409; F01L 2001/34426; F01L 2001/34459;
(Continued)

(56) References Cited

U.S. PATENT DOCUMENTS 9,856,759 B2 * 1/2018 Scheidig ..... F01L 1/34409
10,316,704 B2 * 6/2019 Zschieschang ..... F01L 1/047
(Continued)

FOREIGN PATENT DOCUMENTS

CN 105339609 3/2018
DE 102013204928 9/2014
(Continued)

*Primary Examiner* — Devon C Kramer
*Assistant Examiner* — Kelsey L Stanek
(74) *Attorney, Agent, or Firm* — Volpe Koenig

(57) ABSTRACT

A hydraulic camshaft adjuster (1), in which the locking system (7, 8) includes a first and a second control element (7, 8). In order to approach the middle position easily, the first control element (7) has a first and a second switching position, wherein in the first switching position a fluidic connection between the hydraulic pump (P) and a first of the two sub-chambers (B) and a fluidic connection between the other, second sub-chamber (A) and the tank (T) can be established, and in the second switching position a fluidic connection between the hydraulic pump (P) and the second of the two sub-chambers (A) and a fluidic connection between the other, first sub-chamber (B) and the tank (T) can be established, and the second control element (8) is free from different switching positions and has no influence on the flow of hydraulic fluid.

20 Claims, 6 Drawing Sheets

(58) Field of Classification Search
CPC ... F01L 2001/34463; F01L 2001/34466; F01L 2001/34469; F01L 2250/02
USPC ..... 123/90.15–90.17
See application file for complete search history.

(56) References Cited

U.S. PATENT DOCUMENTS

| | | | | |
|---|---|---|---|---|
| 2012/0017858 | A1* | 1/2012 | Yokoyama | F01L 1/3442 123/90.15 |
| 2016/0024979 | A1 | 1/2016 | Busse | |
| 2016/0069227 | A1 | 3/2016 | Raecklebe | |
| 2017/0089227 | A1 | 3/2017 | Zchieschang | |
| 2017/0096915 | A1 | 4/2017 | Zchieschang | |
| 2019/0153907 | A1* | 5/2019 | Pawade | F01L 1/344 |

FOREIGN PATENT DOCUMENTS

| | | |
|---|---|---|
| DE | 102013226437 | 6/2015 |
| DE | 102014205567 | 10/2015 |
| DE | 102014205569 | 10/2015 |
| DE | 102014207336 | 10/2015 |
| DE | 102014212618 | 12/2015 |

* cited by examiner

HYDRAULIC CAMSHAFT ADJUSTER

CROSS-REFERENCE TO RELATED APPLICATIONS

This application is a 371 National Phase of PCT/DE2018/100794, filed Sep. 19, 2018, which claims the benefit of German Patent Application No. 10 2017 126 171.0, filed Nov. 9, 2017.

TECHNICAL FIELD

The disclosure relates to a hydraulic camshaft adjuster, comprising a stator, in which a rotor is arranged rotatably, the stator having at least one blade, the blade being arranged in a hydraulic chamber of the stator, with the result that a first part chamber is separated from a second part chamber, a central valve which controls the flow of hydraulic fluid into the first part chamber and into the second part chamber, a locking system, by way of which the rotor can be locked relative to the stator in a center position, the locking system comprising a first control element and a second control element which can be held in an unlocked position by way of loading with hydraulic fluid via the central valve, and which can bring about a locking action in the case of the removal of the pressure of the hydraulic fluid, it being possible for the first control element and the second control element to be brought into an operative connection with a slotted guide which is configured in the stator or a component which is connected to the latter, the slotted guide determining an axial position of the control element, a hydraulic pump for providing hydraulic fluid, and a tank for receiving hydraulic fluid.

BACKGROUND

A hydraulic camshaft adjuster of this type is known, for example, from US 2016/069227 A1. In the case of a camshaft adjuster of this type, the aim is to bring about a locking function in the center position of the blade of the rotor in the hydraulic chamber.

In the case of the previously known solution, two spring-loaded locking pins which can be locked in a locking slotted guide which is fixed on the stator are provided in the camshaft adjuster for locking the rotor in the center locking position with respect to the stator, which locking pins lock into the center locking position from different directions in the locking slotted guide in the case of a rotation of the rotor from the "advancing" or "retarding" direction. Here, locking sections and a pressure medium line, through which flow can pass freely, are provided on the locking pins, via which a fluid connection between two operating chambers of different acting directions can be established or blocked in the various positions of the first locking pin and the operating chambers of the different acting directions can be short-circuited by a switching device. A check valve is provided in the pressure medium lines which can be connected in flow terms to the pressure medium circuit by way of the pressure medium line of the locking pin, through which pressure medium line flow can pass freely, which check valve makes an inflow of the pressure medium into one of the operating chambers possible and at the same time prevents a return flow from said operating chamber.

According to this, the center locking mechanism is of relatively complicated construction, which necessitates corresponding costs in the manufacture of the camshaft adjuster.

SUMMARY

The present disclosure is therefore based on the object of configuring a camshaft adjuster of the generic type in such a way that it becomes possible to move to the center position in a simple and reliable way; the structural outlay and therefore the costs are to be minimized or at least reduced.

The achievement of said object by way of the disclosure is characterized in that the first control element has a first and a second switching position, it being possible, in the first, unlocked switching position, for a fluidic connection between the hydraulic pump and a first one of the two part chambers and a fluidic connection between the other, second part chamber and the tank to be established, it being possible, in the second, locked switching position, for a fluidic connection between the hydraulic pump and the second one of the two part chambers and a fluidic connection between the other, first part chamber and the tank to be established, and in that the second control element is free from different switching positions and does not have any influence on the flow of hydraulic fluid.

The central valve preferably has a switching position, in which a fluidic connection is established between the pump and one of the two part chambers, and in which a fluidic connection is established between the other one of the part chambers and the tank. Here, the central valve is preferably connected fluidically to the first control element in said switching position. In addition to the switching position, the central valve can have the normal operation switching positions which are required for the regular operation of the camshaft adjuster.

The stator can have a plurality of hydraulic chambers, and the rotor can have a number of blades which corresponds to the number of hydraulic chambers, only one of the hydraulic chambers being equipped with the first control element and the second control element, and/or the control elements being assigned to one hydraulic chamber in accordance with one preferred embodiment of the disclosure.

One alternative refinement of the disclosure provides that the stator has a plurality of hydraulic chambers, and the rotor has a number of blades which corresponds to the number of hydraulic chambers, more than one of the hydraulic chambers being equipped in each case with the first control element and the second control element, and/or the control elements being assigned to the hydraulic chamber.

In the stator or in a component which is connected to the latter, the slotted guide preferably has an extent in the circumferential direction, which extent corresponds to the spacing between the two control elements in the circumferential direction.

The slotted guide is preferably configured as an arcuate slot in the stator or a component which is connected to the latter.

The control elements are preferably arranged in the rotor, the first control element and the second control element being configured to engage, in the center position, into the slotted guide in the stator or a component which is connected to the latter, in order to establish a mechanical locking action between the rotor and the stator.

Here, the control elements are preferably configured as a pin which is arranged counter to the prestress of a spring in a bore in the rotor.

Therefore, the proposed solution comprises the two control elements (control or switching pins) which are assigned to one hydraulic chamber, one of the control elements being configured with said switching function, whereas the other control element does not have any switching function of this type, but rather merely can be pressed into the slotted guide as a spring-prestressed element (in the case of the locking action) or (in the case of the normal operation of the camshaft adjuster) is pushed out of the acting region of the slotted guide in the case of corresponding pressure loading.

Therefore, in addition to the task of locking, one of the two control elements also has the task of switching of the hydraulic fluid, in order to achieve said action, that is to say to move to the center position and therefore the locked state in a simple way.

Solutions are also conceivable, in the case of which a second switching valve is provided, in order to make a higher throughflow possible. Furthermore, solutions with an additional "mechanical ratchet" are possible.

The center position can be moved to in a simple and reliable way by way of the proposed solution. The concept is based on a purely hydraulic adjustment, in order to move the rotor relative to the stator into the center position and to lock it there. Alternating camshaft torques are not required for this purpose (as in the case of some previously known solutions).

In an advantageous way, only relatively few components are required for the proposed solution, which ensures favorable manufacturing costs. In particular, check valves which are required in the case of previously known solutions can be dispensed with in part.

BRIEF DESCRIPTION OF THE DRAWINGS

Exemplary embodiments of the disclosure are shown in the figures, in which.

DETAILED DESCRIPTION

Figure 1:
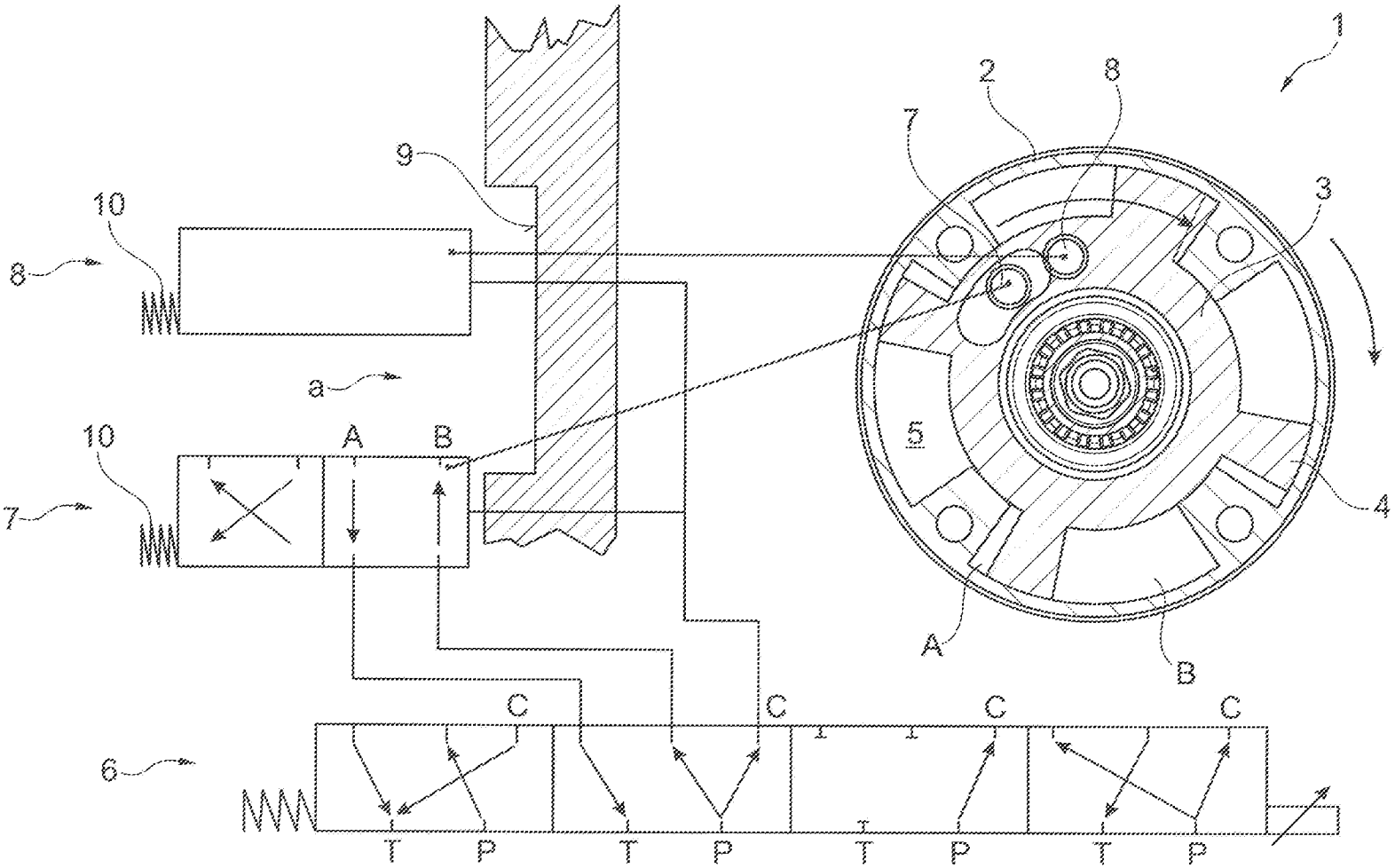
FIG. 1 diagrammatically shows the hydraulic control of a camshaft adjuster, the adjustment in normal operation being shown, in the case of which an adjustment has been carried out in the "advancing" direction, FIG. 2 diagrammatically shows the hydraulic control of the camshaft adjuster, the adjustment in normal operation being shown, in the case of which an adjustment has been carried out in the "retarding" direction, FIG. 3 diagrammatically shows the hydraulic control of the camshaft adjuster, the moving of the locking action into a center position for a first relative position between the stator and the rotor being shown, FIG. 4 diagrammatically shows the hydraulic control of the camshaft adjuster, the moving of the locking action into a center position for a second relative position between the stator and the rotor being shown, FIG. 5 diagrammatically shows the hydraulic control of the camshaft adjuster, the achieving of the locking action in the center position being shown.

The figures diagrammatically show a camshaft adjuster 1 which has a stator 2 and a rotor 3 which can be rotated relative to the latter. The rotor 3 has a number of blades 4 which reach into respective hydraulic chambers 5 of the stator 2 and divide a first part chamber A from a second part chamber B here. During regular operation of the camshaft adjuster 1, a desired relative rotational position between the stator 2 and the rotor 3 is established by way of the feeding of hydraulic oil via a central valve 6 into the part chambers A and/or B.

In the following text, only the novel features of the hydraulic camshaft adjuster are described, since the general method of operation of an adjuster of this type is well known. In respect of the hydraulic control of an element of this type and, in particular, in respect of the actuation of the adjuster with a central valve, reference is made expressly, for example, to DE 10 2013 226 437 B4 of the patent applicant, where detailed information in this regard is contained.

Accordingly, during normal operation of the camshaft adjuster 1, the part chambers A and B are supplied with hydraulic oil in a desired way. In this operating mode, a locking system 7, 8 is passive, which is brought about by the fact that pressurized oil is conducted into a C-port. This has the consequence that two control elements 7 and 8 are pressed counter to a spring 10 by the pressure of the hydraulic fluid in such a way that the control elements 7 and 8 assume an unlocked position and therefore the camshaft adjuster 1 is in its normal operating position.

Accordingly, in the case of the C-port being loaded with pressurized oil by a hydraulic pump P, the two control elements 7 and 8 are held counter to the action of the spring 10 in a position, in which no locking of the rotor 3 relative to the stator 2 takes place.

Figure 2:
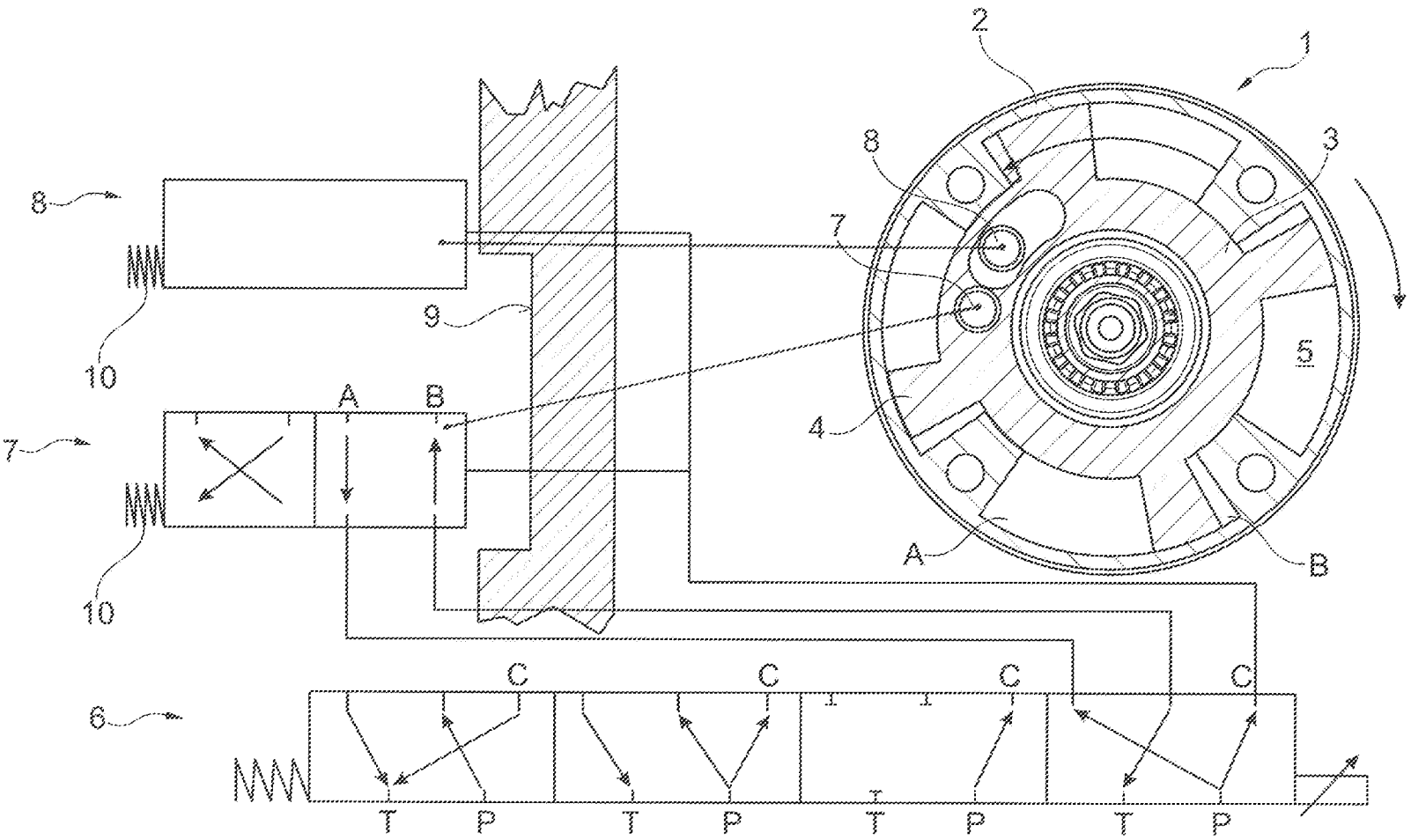

The regular operation of the camshaft adjuster 1 is shown in FIGS. 1 and 2. Here, the central valve 6 can assume three switching positions which correspond to the three right-hand positions (of the total of four possible positions shown of the central valve 6).

In FIG. 1, hydraulic fluid is conducted into the C-port via the hydraulic pump P, as a result of which the two control elements 7 and 8 are in the unlocked position. At the same time, hydraulic fluid is conducted into the part chamber B. Furthermore, in said switching position, the part chamber A is connected to the tank T. Accordingly, the oil volume increases in the part chamber B and decreases in the part chamber A, with the result that the rotor 3 rotates in the clockwise direction with respect to the stator 2.

The reverse case is shown in FIG. 2, in the case of which first of all the C-port is likewise pressurized and thus the two control elements 7 and 8 are in the unlocked position. Hydraulic fluid is then conducted, however, from the hydraulic pump P into the part chamber A, whereas the part chamber B is at the same time connected to the tank T. Accordingly, the oil volume now increases in the part chamber A and decreases in the part chamber B, with the result that the rotor 3 rotates counter to the clockwise direction with respect to the stator 2.

In that position of the central valve 6 which lies between the two said positions, the flow from the hydraulic pump P and to the tank T is interrupted, with the result that no relative rotation can take place between the rotor 3 and the stator 2. Merely the C-port is pressurized and holds the two control elements 7 and 8 in the unlocked position.

Figure 5:
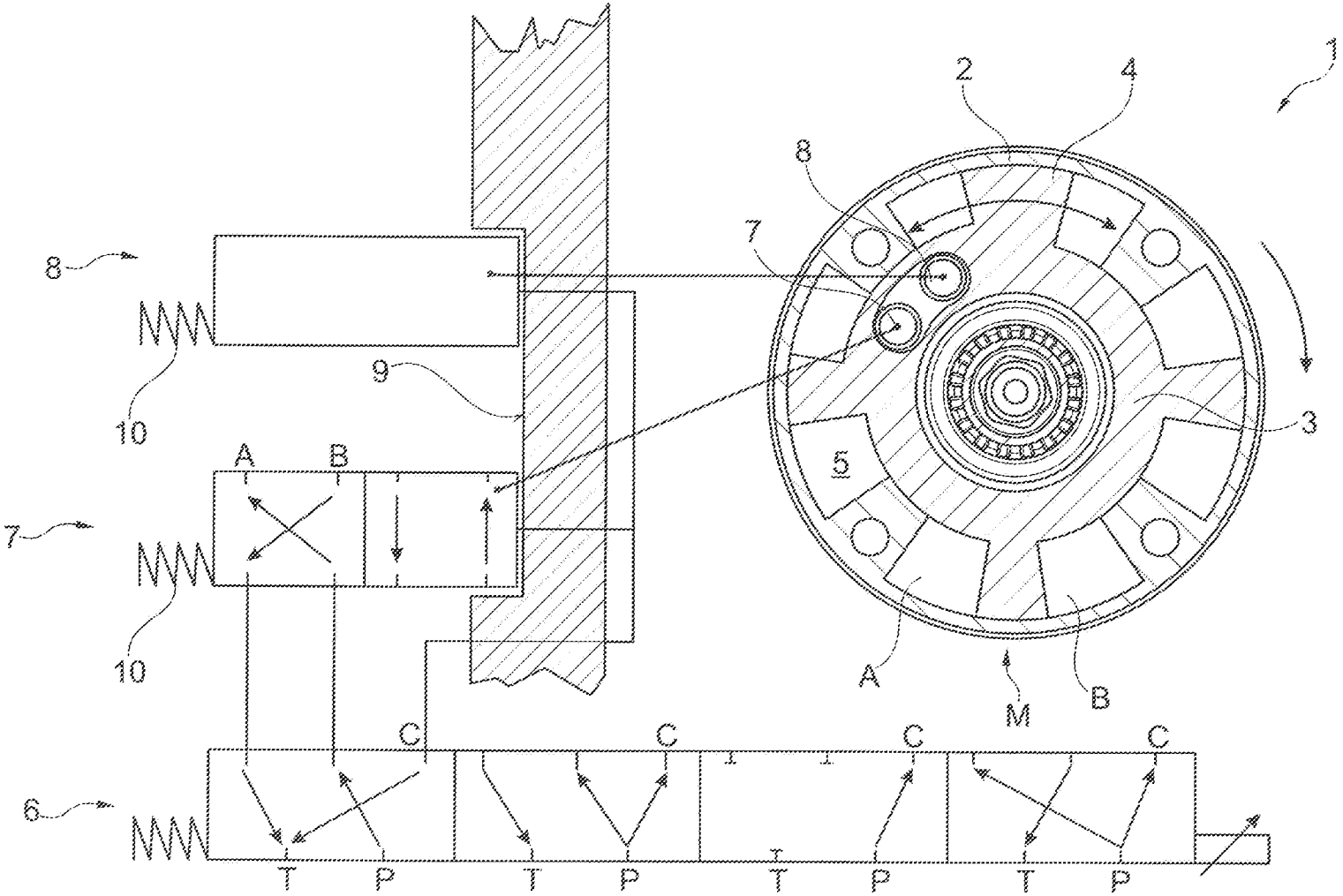

The aim is to ensure, in the case of an engine stop of the internal combustion engine, that the rotor 3 comes to lie relative to the stator 2 in a center position M, as shown in FIG. 5.

This is brought about by way of the two control elements 7 and 8 in the form of control pins which can move in an axial direction a (see FIG. 1) in corresponding bores in the rotor 3, to be precise counter to the action of the spring 10. The axial movement of the control elements 7 and 8 is brought about by way of a slotted guide 9 which is machined into the cover of the stator 2 and the contour of which is shown merely diagrammatically in the figures. If the control elements 7, 8 pass into the region of the slotted guide 9, this results in an axial displacement, as arises from the comparison of the individual figures.

Here, the first control element 7 is configured in such a way that it has or can assume a first and a second switching position; the two switching positions can be seen from the figures. In the first, unlocked switching position (pressure prevails in the C-port, and the control element 7 is pressed counter to the spring 10), a fluidic connection between the hydraulic pump P and a first one of the two part chambers A, B and a fluidic connection between the other, second part chamber A, B and the tank T can be established, which is dependent on the corresponding position of the central valve 6 which has to be situated in the position on the extreme left to this end (as shown in FIGS. 3 to 6). In the second, locked switching position (the pressure in the C-port is removed, and the control element 7 is pressed in the direction of the slotted guide 9 as a consequence of the action of the spring 10), a fluidic connection between the hydraulic pump P and the second one of the two part chambers A, B and a fluidic connection between the other, first part chamber A, B and the tank T can be established.

In the meantime, the second control element 8 is free from different switching positions and does not have any influence on the flow of hydraulic fluid. It is pressed to the right in the direction of the slotted guide 9 as a consequence of the action of the spring 10; whether the control element 8 moves into the slotted guide 9 is dependent on the relative position between the stator 2 and the rotor 3 and also on whether pressure prevails in the C-port.

Accordingly, the following method of operation results, in order to move the rotor 3 relative to the stator 2 into the center position M and to lock it here.

Figure 3:
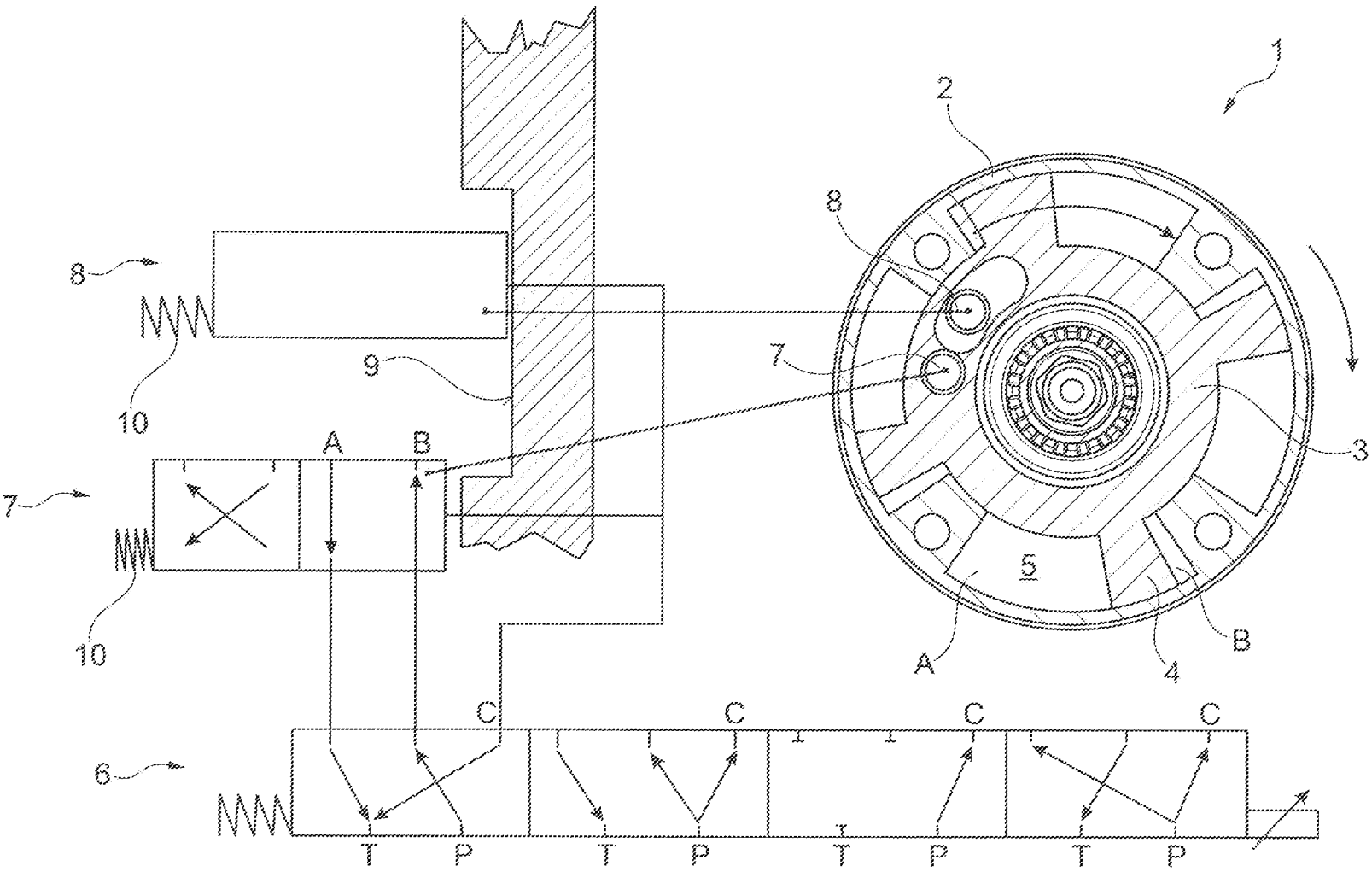

According to FIG. 3, the pressure in the C-port is removed. On account of the relative position between the rotor 3 and the stator 2, the control element 8 has already been able to enter into the slotted guide 9; this does not apply, however, to the control element 7 which is still situated outside the region of the slotted guide 9. Accordingly, the switching position of the control element 7 is present, as is apparent from FIG. 3. After this, hydraulic fluid is conducted from the hydraulic pump P into the part chamber B, whereas hydraulic fluid can flow out of the part chamber A into the tank T. This brings about a relative rotation between the rotor 3 and the stator 2, which relative rotation moves the control element 7 into the region of the slotted guide 9, where it can latch into said slotted guide 9. In this way, the locked state in the center position M according to FIG. 5 is reached.

Figure 4:
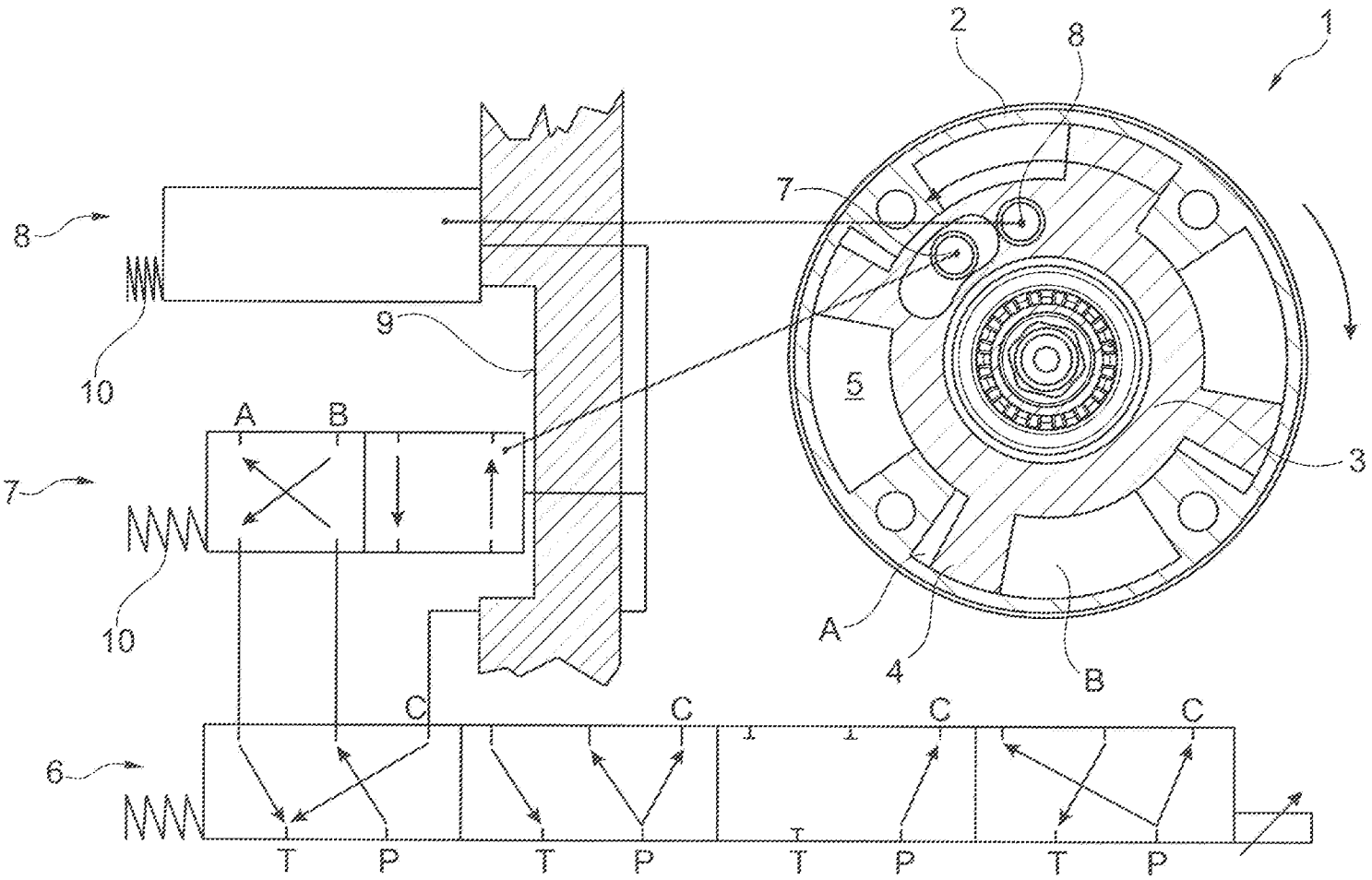

If, in the case of the pressure being removed from the C-port, the control element 7 is already in the meantime situated in the region of the slotted guide 9, as shown in FIG. 4, said control element 7 can enter in the axial direction a into the slotted guide 9 and can thus pass into the switching position, where hydraulic fluid can pass from the hydraulic pump P into the part chamber A; here, the part chamber B is connected to the tank T.

Accordingly, a backward rotation of the rotor 3 relative to the stator 2 can take place, with the result that the locked position which is shown in FIG. 5 can likewise be assumed.

Figure 6:
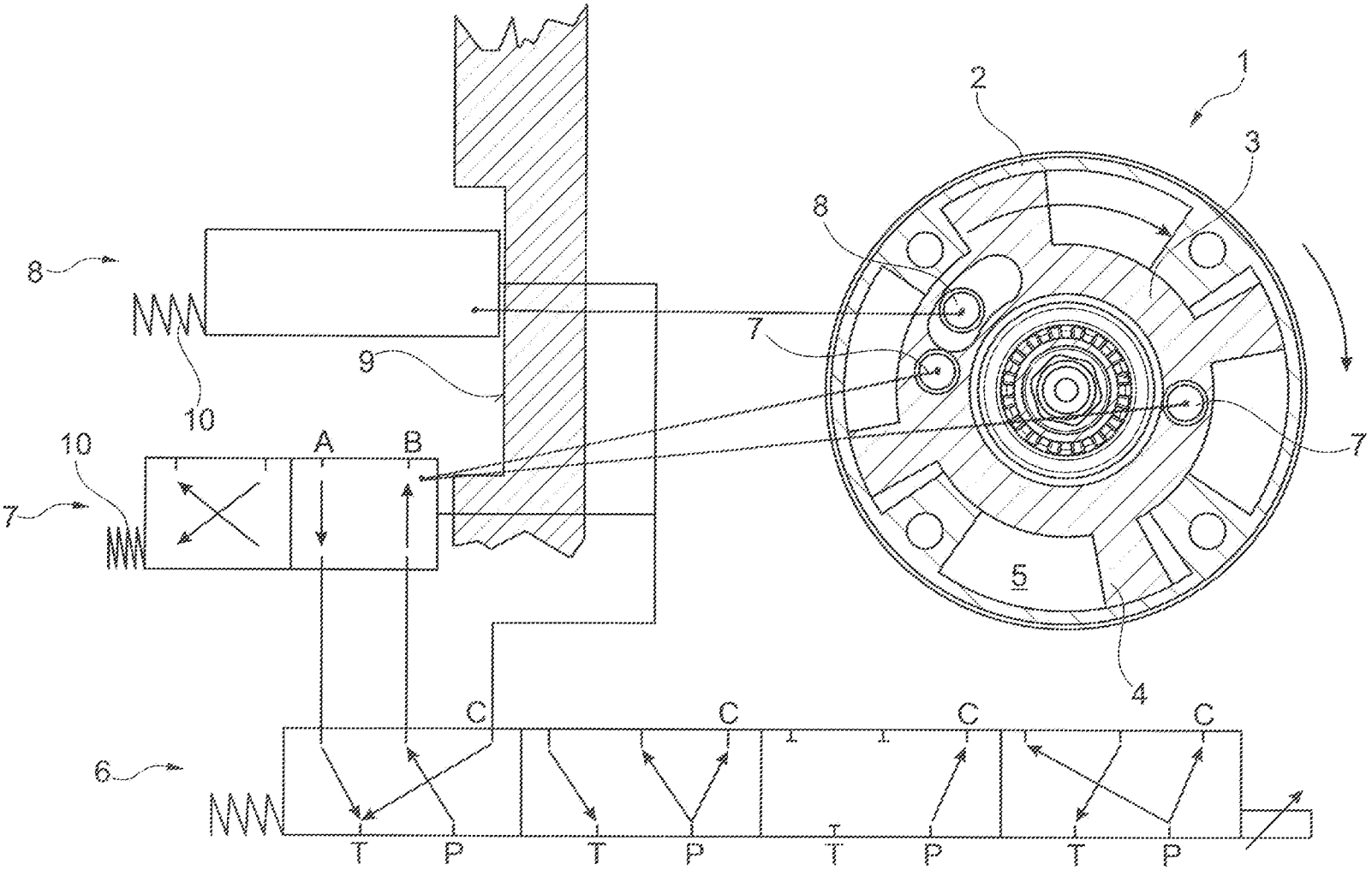
FIG. 6 shows an illustration which is analogous with respect to FIG. 3, the use of a second control element being shown.

FIG. 6 indicates that more than one set of control elements 7, 8 can also be provided. A second control element 7 which interacts with another hydraulic chamber 5 is indicated here.

LIST OF DESIGNATIONS

1 Camshaft adjuster
2 Stator
3 Rotor
4 Blade
5 Hydraulic chamber
6 Central valve
7, 8 Locking system
7 First control element (control or switching pin)
8 Second control element (control or switching pin)
9 Slotted guide
10 Spring
A First part chamber
B Second part chamber
C C-port for unlocking
P Hydraulic pump
T Tank
a Axial direction
M Center position

The invention claimed is:

1. A hydraulic camshaft adjuster, comprising a stator having a hydraulic chamber;

a rotor arranged rotatably in the stator, the rotor having at least one blade arranged in the hydraulic chamber of the stator to define a first part chamber that is separated from a second part chamber;

a central valve configured to control a flow of hydraulic fluid into the first part chamber and into the second part chamber;

a locking system configured to lock the rotor relative to the stator in a center position, the locking system comprising a first control element and a second control element which are holdable in an unlocked position by loading with hydraulic fluid via the central valve, and which bring about a locking action in case of a removal of pressure of the hydraulic fluid, the first control element and the second control element are movable into an operative connection with a slotted guide in the stator or a component connected to the stator, the slotted guide determining an axial position of the first and second control elements;

a hydraulic pump for providing hydraulic fluid;

a tank for receiving hydraulic fluid;

wherein the first control element has a first, unlocked, switching position and a second, locked, switching position, and in the first switching position, a fluidic connection between the hydraulic pump and the first part chamber of the first part chamber and the second part chamber and a fluidic connection between the second part chamber and the tank are established, and in the second switching position, a fluidic connection between the hydraulic pump and the second of the first part chamber and the second part chamber and a fluidic connection between the first part chamber and the tank are established, and wherein the second control element is free from different switching positions and does not influence the flow of hydraulic fluid.

2. The hydraulic camshaft adjuster as claimed in claim 1, wherein the central valve has a switching position, in which a fluidic connection is established between the pump and one of the two part chambers, and in which a fluidic connection is established between the other one of the part chambers and the tank.

3. The hydraulic camshaft adjuster as claimed in claim 2, wherein the central valve is connected fluidically to the first control element in the first and second switching position.

4. The hydraulic camshaft adjuster as claimed in claim 3, wherein in addition to the switching positions, the central valve has normal operation switching positions which are required for regular operation of the camshaft adjuster.

5. The hydraulic camshaft adjuster as claimed in claim 1, wherein there are a plurality of the hydraulic chambers, and a number of the blades of the rotor corresponds to a number of hydraulic chambers.

6. The hydraulic camshaft adjuster as claimed in claim 1, wherein there are a plurality of the hydraulic chambers, and a number of the blades corresponds to a number of hydraulic chambers.

7. The hydraulic camshaft adjuster as claimed in claim 1, wherein in the stator or in the component which is connected to the stator, the slotted guide has an extent in a circumferential direction, which extent corresponds to a spacing between the two control elements in the circumferential direction.

8. The hydraulic camshaft adjuster as claimed in claim 1, wherein the slotted guide is configured as an arcuate slot in the stator or in the component which is connected to the stator.

9. The hydraulic camshaft adjuster as claimed in claim 1, wherein the control elements are arranged in the rotor, the first control element and the second control element are configured to engage, in a center position (M), into the slotted guide in the stator or the component connected to the stator, in order to establish a mechanical locking action between the rotor and the stator.

10. The hydraulic camshaft adjuster as claimed in claim 1, wherein the control elements are each configured as a pin which is arranged counter to a prestress of a spring in a respective bore in the rotor.

11. The hydraulic camshaft adjuster as claimed in claim 1, wherein there are a plurality of the hydraulic chambers, and the control elements are assigned to one hydraulic chambers.

12. The hydraulic camshaft adjuster as claimed in claim 1, wherein there are a plurality of the hydraulic chambers, and more than one of the hydraulic chambers are assigned a control element to.

13. A hydraulic camshaft adjuster, comprising a stator having a hydraulic chamber;

a rotor arranged rotatably in the stator, the rotor having at least one blade arranged in the hydraulic chamber of the stator to define a first part chamber that is separated from a second part chamber;

a central valve configured to control a flow of hydraulic fluid into the first part chamber and into the second part chamber, the central valve including a hydraulic pump connection for receiving hydraulic fluid and a tank connection adapted for discharging hydraulic fluid to a tank;

a locking system configured to lock the rotor relative to the stator, the locking system comprising first and second control elements which are held in an unlocked position by loading with hydraulic fluid via the central valve, and which bring about a locking action in case of a removal of the loading by the hydraulic fluid, the first control element and the second control element are movable into an operative connection with a slotted guide in the stator or a component connected to the stator, the slotted guide determining an axial position of the control elements;

wherein the first control element has a first, unlocked, switching position and a second, locked, switching position, and in the first switching position, a fluidic connection between the hydraulic pump connection and the first part chamber of the two part chambers and a fluidic connection between the second part chamber and the tank connection are established, and in the second switching position, a fluidic connection between the hydraulic pump connection and the second part chamber of the two part chambers and a fluidic connection between the first part chamber and the tank connection are established, and wherein the second control element is free from different switching positions and does not influence the flow of hydraulic fluid.

14. The hydraulic camshaft adjuster as claimed in claim 13, wherein the central valve has a switching position, in which a fluidic connection is established between the pump connection and one of the first part chamber and the second part chamber, and in which a fluidic connection is established between the other one of the part chambers and the tank.

15. The hydraulic camshaft adjuster as claimed in claim 13, wherein the central valve is connected fluidically to the first control element in the first and second switching position.

16. The hydraulic camshaft adjuster as claimed in claim 15, wherein, in addition to the switching positions, the central valve has normal operation switching positions which are required for regular operation of the camshaft adjuster.

17. The hydraulic camshaft adjuster as claimed in claim 13, wherein there are a plurality of the hydraulic chambers, and a number of the blades of the rotor corresponds to a number of hydraulic chambers, and only one of the hydraulic chambers is equipped with the first control element and the second control element.

18. The hydraulic camshaft adjuster as claimed in claim 13, wherein there are a plurality of the hydraulic chambers, and a number of the blades corresponds to a number of hydraulic chambers.

19. The hydraulic camshaft adjuster as claimed in claim 13, wherein in the stator or in the component which is connected to the stator, the slotted guide has an extent in a circumferential direction, which extent corresponds to a spacing between the two control elements in the circumferential direction.

20. The hydraulic camshaft adjuster as claimed in claim 13, wherein the slotted guide is configured as an arcuate slot in the stator or in the component which is connected to the stator.

* * * * *